United States Patent [19]

Kobayashi et al.

[11] Patent Number: 4,646,380

[45] Date of Patent: Mar. 3, 1987

[54] ROTARY CLEANING MEMBER IN CLEANER

[75] Inventors: Kiyoshi Kobayashi, Noda; Toshihiro Tsuchiya, Kashiwa, both of Japan

[73] Assignee: Hukuba Kogyo Kabushiki Kaisha, Chiba, Japan

[21] Appl. No.: 757,516

[22] Filed: Jul. 19, 1985

[30] Foreign Application Priority Data

Jul. 25, 1984 [JP] Japan ..... 59-154847

[51] Int. Cl.[4] ..... A47L 11/33

[52] U.S. Cl. ..... 15/41 R; 15/43; 15/179; 15/230.16

[58] Field of Search ..... 15/41 R, 41 B, 230.14, 15/230.16, 43, 230.19, 179, 42–46, 47; 51/395

[56] References Cited

U.S. PATENT DOCUMENTS 848,974 4/1907 Crossman ..... 16/230.16
1,267,304 5/1918 Adams ..... 15/230.16
1,370,256 3/1921 Adams ..... 15/230.16

FOREIGN PATENT DOCUMENTS 642819 9/1950 United Kingdom ..... 15/230.16

*Primary Examiner*—Edward L. Roberts
*Attorney, Agent, or Firm*—Jordan B. Bierman

[57] ABSTRACT

A rotary cleaning member comprises a revolving shaft installed rotatably inside a main body casing, and a plurality of flexible blades provided with a number of projections on the surface thereof abutting upon the surface of a floor, these blades extending radially from the circumference of the revolving shaft one another in a cleaner wherein the rotary cleaning member installed in the main body casing is rotated to spring up dust or the like on the floor, or convey the dust or the like sprung up by means of said rotary cleaning member to a prescribed position for receiving the dust or the like in combination with suction.

5 Claims, 12 Drawing Figures

ROTARY CLEANING MEMBER IN CLEANER

BACKGROUND OF THE INVENTION

1. Field of the Invention

This invention relates to a rotary cleaning member in cleaners, and particularly to such a rotary cleaning member which is not caught in cotton-like waste such as pieces of thread, pieces of cotton and the like laying on floor, but can receive the same in its dust room of cleaner, besides has improved dust collecting property in respect of finely divided materials such as sand, dust and the like.

2. Description of the Prior Art

Conventional rotary cleaning members in cleaners relate generally to rotary brushes having cylindrical shape as a whole which is arranged in such that a number of bristles of brush extend radially from the center of its shaft. Such type of cleaner receives directly dust on a floor by rotating such a rotary brush to spring out the dust, or conveys such dust to a prescribed dust container in combination with suction. In such a conventional type of rotary cleaner, however, since the extreme end portion of bristles in its brush holds easily cotton-like waste such as pieces of thread, pieces of cotton and the like, the rotary cleaner cannot receive the cotton-like waste in its dust room so that the rotary brush is caught by the cotton-like waste. It results in levelling of bristles of brush, so that conventional cleaners have such disadvantage of reducing dust collecting property. In order to eliminate the disadvantage, such rotary cleaner is provided with a comb teethlike part to abut it against the circumferential portion of the rotary brush, whereby pieces of thread, pieces of cotton or the like are combed off by the comb teeth-like part so that the rotary brush is released from catching by cotton-like waste. However, the effect for eliminating the disadvantage has been insufficient. Thus, it has been years of the problem to be solved in such type of cleaners as mentioned above.

In this connection, the present applicant has proposed an improved cleaner by which the disadvantage of conventional cleaners as described above can be eliminated, i.e., the rotary cleaning member thereof is not caught by pieces of thread, pieces of cotton or the like lying on floor at the time of cleaning, whereby smooth cleaning may be performed (for example, Japanese patent application Ser. No. 216589/1982 filed on Dec. 10, 1982 and entitled "Rotary Cleaning Member in Cleaner"). FIGS. 9 through 10 illustrate a state wherein the rotary cleaning member in cleaners according to the above prior application is attached to a manual cleaner. In FIGS. 9 and 10, a main body casing 1 comprises a rectangular opened bottom, the top inclining towards the bottom in any direction except for the central part, and the central part on the upper surface of which is provided with a connecting portion (not shown) to a handle. A revolving shaft 4 is provided with driven wheels 2 at both the end portions and a rotary cleaning member 3 in the central portion thereof. The revolving shaft 4 is rotatably installed between both side plates 1*a* and 1*b* inside the main body casing 1 in the central position thereof under such condition that the lower part of the aforesaid rotary cleaning member projects from said main body casing 1. Shafts 5 and 6 being parallel to the revolving shaft 4 are also installed between both the side plate 1*a* and 1*b* in front and the rear of said revolving shaft 4. Driving rollers 7 and 8 being pressed against said driven wheels 2, respectively, and each lower part thereof projecting downwardly from said opened part of the main body casing 1 are provided on the shaft 5 and 6.

Furthermore each plate 9 extending substantially horizontally with a spacing between the plate 9 and either side plate 1*a* or 1*b* of the main body casing 1 and which permits said driving rollers 7 and 8 to position therebetween is disposed on the bottom opened part of the main body casing 1 on the side of the front end of said rotary cleaning member 3 or the bottom opened part of the main body casing 1 on the side of the rear end thereof. A part of the plate 9 adjacent to the rotary cleaning member 3 rises upwardly to form half of a dust room.

The rotary cleaning member 3 is provided with a plurality of blades 10 in parallel to the axis of the revolving shaft 4 on the circumference thereof, respectively, in such a manner that one side portion of each blade is fixed to the revolving shaft 4 to extend it radially therefrom as shown in FIG. 11. Each blade 10 is made of a resilient sheet having flexibiity such as rubber sheet, synthetic resin sheet, metallic spring sheet and the like, such blade bends sufficiently when the same abuts upon the surface of floor, and any number of the blades 10 may be used.

In the construction of a manual cleaner as described above, when the main body casing 1 is placed on floor, the lower surfaces of the driving rollers 7 and 8 projecting from the bottom opened part of the casing 1 abut upon the surface of a floor. In this case, said driving rollers 7 and 8 may abut upon the floor without any trouble, because the blade 10 of the rotary cleaning member 3 contacting with the floor bends. When the main body casing 1 is slid on the surface of the floor in front and the rear directions by utilizing a handle (not shown), the driving rollers 7 and 8 roll on the floor, and at the same time the rotary cleaning member 3 is also rotated through the driven wheels 2 being pressed against these driving rollers 7 and 8. Due to rotation of the rotary cleaning member 3, each blade 10 rotates to convey dust to a dust room and at the same time, the blade 10 which has abutted against the floor and bent is released from the floor so that such blade 10 springs out dust and the like lying on the floor at the moment of such release by means of elastic force which has been accumulated inside the blade 10 during a period wherein such blade is bent thereby to receive the dust and the like in the dust room. More specifically, dust on the floor is introduced into the dust room by means of the elastic force and rotating force at the time when each blade 10 leaves from the floor.

In accordance with such construction of the rotary cleaning member as described above, there is not such case where the extreme end portion of the blade 10 which is in abutting condition against the surface of the floor is caught by cotton-like waste such as pieces of theread, pieces of cotton or the like and hence, the rotary cleaning member is not caught by any cotton-like waste.

However, when the rotary cleaning member in such a cleaner is on a carpet floor where there are a number of fine concave and convex portions due to the pile thereof, the blade 10 bends at a convex portion 11, but does not abut upon a concave portion 12 in the floor surface as shown in FIG. 12, because said blade 10 is composed of a flat elastic plate. For this reason, there is a fear of such case where said rotary cleaning member cannot clean up such dust, particularly fine dust or the like stored in the concave portion 12. More specifically, there has been a case where a rotary cleaning member in conventional cleaners cannot make the blade 10 to follow concave and covex portions on floor, so that the blade 10 cannot sufficiently abut against the whole surface of a carpet.

SUMMARY OF THE INVENTION

In view of the above, the present invention has been made and an object thereof is to provide a rotary cleaning member with the surface of each blade of which is provided a number of projections by which the rotary cleaning member is not caught by cotton-like waste such as pieces of thread, pieces of cotton and the like, and at the same time dust collecting property for fine dust such as sand or the like is improved in case of cleaning up, of course, a flat floor surface and even an uneven floor surface, whereby smooth cleaning can be performed.

According to the present invention, there is provided a rotary cleaning member comprising a revolving shaft installed rotatably inside a main body casing, and a plurality of flexible blades provided with a number of projections on the surface thereof abutting upon the surface of a floor, said blades extending radially from the circumference of said revolving shaft one another in a cleaner wherein said rotary cleaning member installed in said main body casing is rotated to spring up dust or the like on the floor, or convey the dust or the like sprung up by means of said rotary cleaning member to a prescribed position for receiving the dust or the like in combination with suction.

DESCRIPTION OF THE PREFERRED EMBODIMENTS

Figure 1:
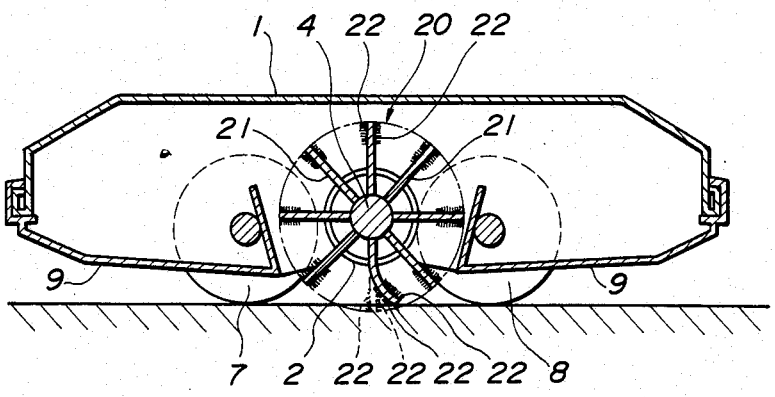
FIG. 1 is a front elevational view showing the manual cleaner according to an embodiment of the present invention.
Figure 3:
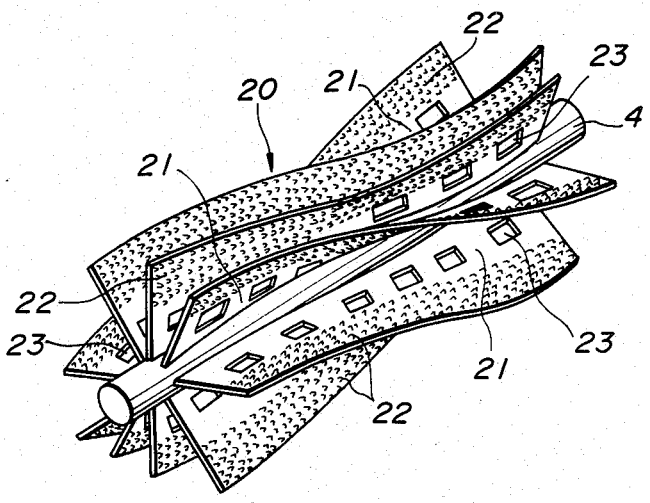
FIG. 3 is a schematic perspective view showing the rotary cleaning member according to an embodiment of the present invention.
Figure 2:
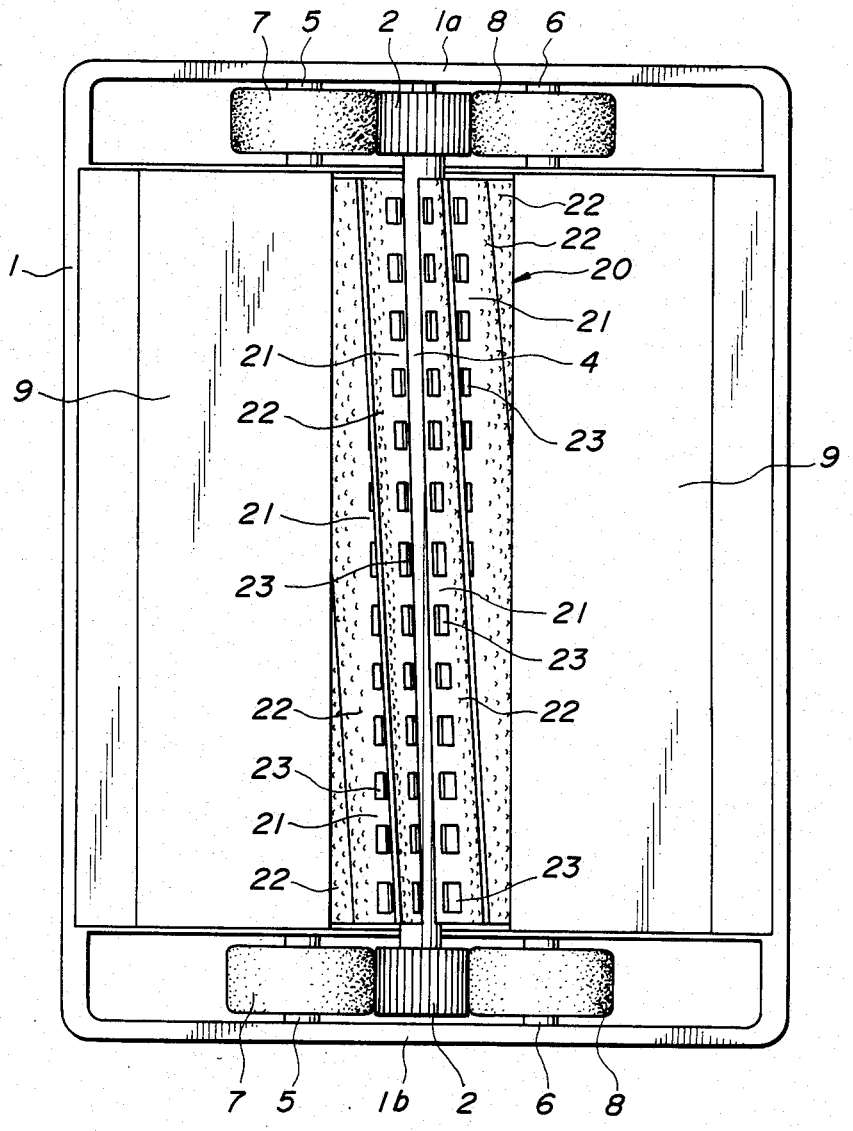
FIG. 2 is a bottom view of FIG. 1.

The rotary cleaning member in cleaners according to the present invention will be described hereinbelow by referring to the accomapnying drawings wherein FIGS. 1 through 3 illustrate an embodiment of the present invention, and FIGS. 1 and 2 show a rotary cleaning member installed in the manual cleaner in accordance with the present invention in which like parts are shown by corresponding reference numerals throughout FIGS. 9–12, so that the description to be repeated will be omitted.

In a rotary cleaning member 20, the circumference of a revolving shaft 4 is provided with a plurality of blades 21 in such that each one longitudinal end of which is spirally fixed to said circumference of the revolving shaft 4 and extends radially therefrom in parallel to one another. The lower part of these blades 21 projects from a main casing body 1. Each blade 21 is made of a resilient sheet or plate having flexibility such as rubber, synthetic resin, metallic spring or the like sheets or plates, the resulting blade bends sufficiently when the same abuts upon the surface of a floor, and any number of the blades 21 may be suitably selected, though eight blades are selected in the present embodiment. Furthermore a number of projections 22 are provided on such part of the surface of said blade abutting upon the surface of a floor. Window portions 23 are further defined on each blade 21 in the vicinity of a portion where the blade 21 is fixed to the revolving shaft 4 by cutting the blade corresponding to the window portion off therefrom.

In the construction as described above, when the main body casing 1 is placed on a floor, the lower surfaces of driving rollers 7 and 8 projecting from a bottom opened part of the casing 1 abut upon the surface of the floor. In this case, said driving rollers 7 and 8 may abut upon the floor without any trouble, because the blade 21 of the rotary cleaning member 20 contacting with the floor bends. When the main body casing 1 is slid on the surface of the floor in front and the rear directions by utilizing a handle (not shown), the driving rollers 7 and 8 roll on the floor, and at the same time the rotary cleaning member 20 is also rotated through driven wheels 2 being pressed against these driving rollers 7 and 8. Due to rotation of the rotary cleaning member 20, the respective blades 21 rotate so that dust is conveyed to a dust room by means of such rotation, and at the same time the blade 21 which has abutted against the floor and bent is released from the floor so that such blade 21 springs out dust and the like lying on the floor at the moment of such release by means of elastic force which has been accumulated inside the blade 21 during a period wherein such blade is bent thereby to receive the dust and the like in the dust room. In this case, since the revolving shaft 4 is spirally provided with a plurality of blades 21, dust and the like lying on the floor may be continuously sprung up by means of these blades.

Figure 4:
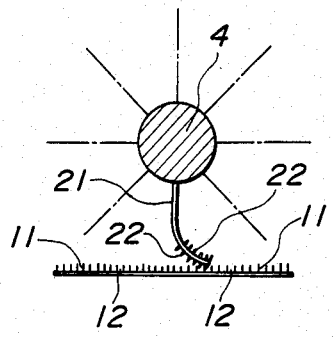
FIG. 4 is an explanatory view illustrating a situation wherein the rotary cleaning member shown in FIG. 3 is utilized for cleaning operation.

In case where unevenness is observed on a floor, a number of projections 22 encroach upon concave portions 12, respectively, to sweep up fine dirt positioned in the concave portions 12 as shown in FIG. 4. The fine dirt thus swept is introduced into the dust room and contained therein by means of elasticity derived from the instance when each blade 21 leaves the floor as well as turning force of the rotary cleaning member 20.

Furthermore since each blade 21 is provided with the notched window portions 23, transmission in vibration of the blades 21 due to the rotation may be controlled so that noise derived from vibration of the blades can be prevented.

Figure 5:
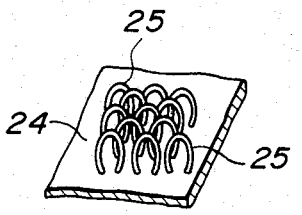
FIG. 5 is an explanatory view showing another construction of projections.

A number of the projections 22 may be provided on each blade 21 by such a manner that loop-like piled portions 25 are formed on a base fabric 24 as a lot of the projections 22, and the resulting base fabric 24 is bonded to the surface of each blade 21 abutting against the surface of floor as shown, for example, in FIG. 5.

Figure 6:
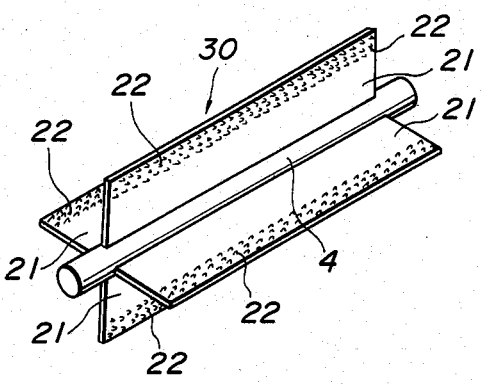
FIGS. 6 through 8 are schematic perspective views each showing another example of the rotary cleaning member according to the present invention.

FIG. 6 illustrates the rotary cleaning member in accordance with another embodiment of the present invention and in this rotary cleaning member 30, a plurality of blades 21 are radially provided on the circumference of a revolving shaft 4 by securing either longitudinal side of each blade 21 thereto in parallel direction with respect to the axial direction of the revolving shaft 4, and further the extreme end of each blade 21 is provided with a number of projections 22 in the surface of the blade abutting upon the surface of floor. Such rotary cleaning member in this embodiment can easily be manufactured.

Figure 7:
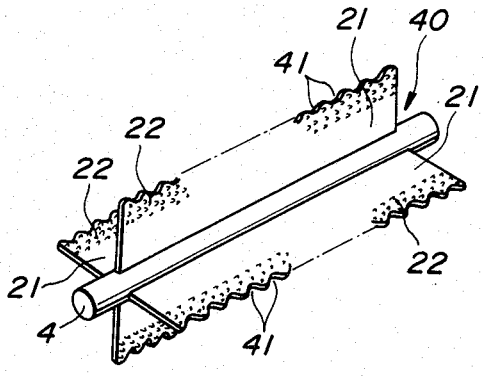

A rotary cleaning member 40 shown in FIG. 7 is obtained from blades 21 of a saw-toothed shape each of which is formed by cutting the extreme end (cut portion 41) of a blade 21 with a prescribed spacing, respectively. In such construction as described above, more elasticity than that described in the embodiment of FIG. 6 may be afforded to the extreme end portion of each blade 21.

Figure 8:
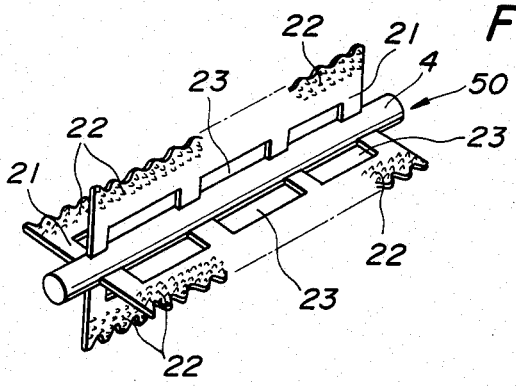
Figure 9:
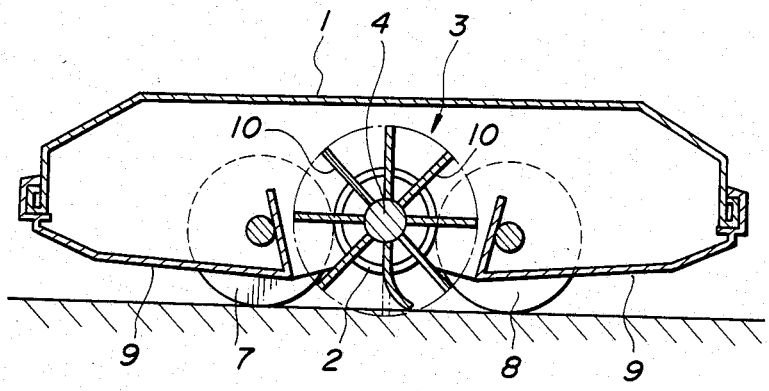
FIG. 9 is a front elevational view showing the manual cleaner wherein the rotary cleaning member according to the present invention is installed.
Figure 11:
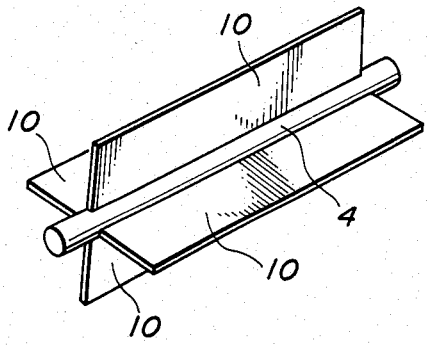
FIG. 11 is a schematic perspective view showing the rotary cleaning member according to the present invention.
Figure 12:
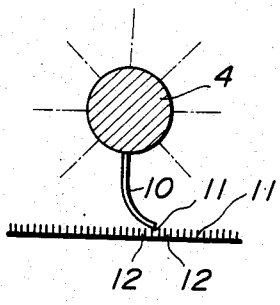
FIG. 12 is an explanatory view illustrating a situation wherein the rotary cleaning member shown in FIG. 11 is utilized for cleaning operation.
Figure 10:
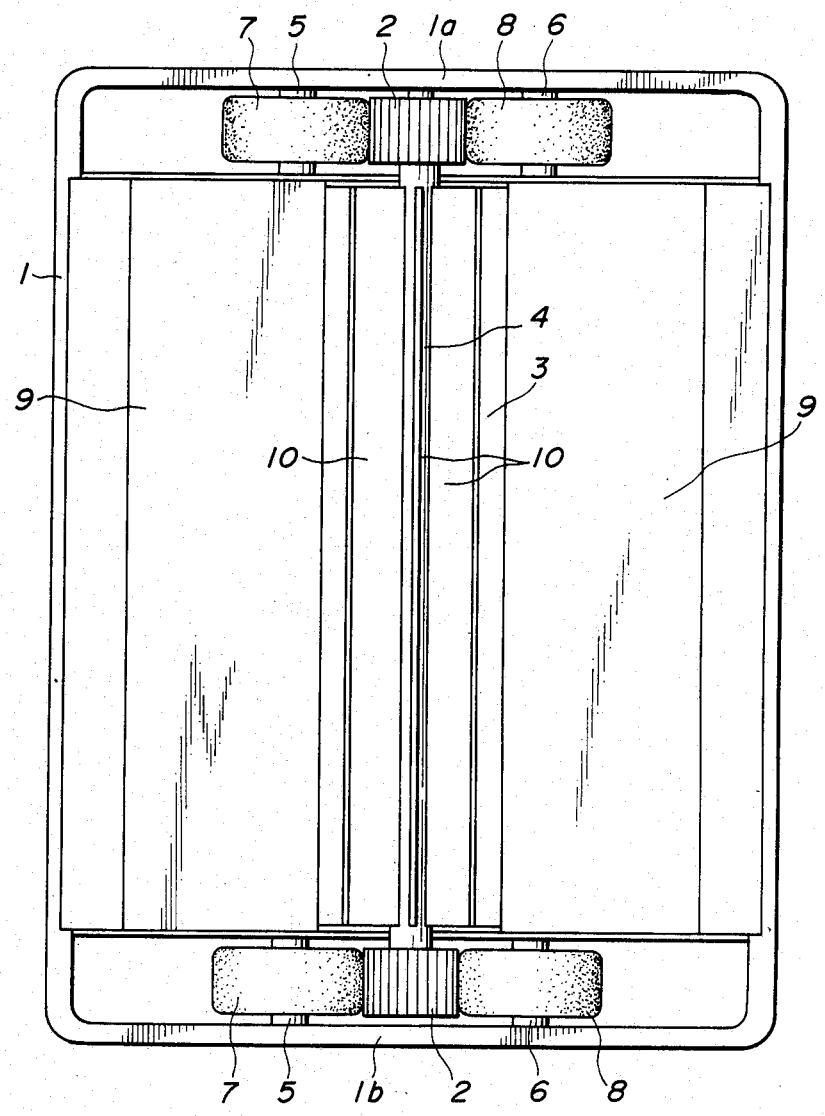
FIG. 10 is a bottom view of FIG. 9.

In a rotary cleaning member 50 shown in FIG. 8, window portions 23 are further defined on each blade 21 as that illustrated in FIG. 7.

While the present invention has been described in respect of the case where the aforementioned embodiments of the rotary cleaning member are applied to manual cleaners, such embodiments may, of course, be applied also to vacuum cleaners.

As described above, in accordance with the rotary cleaning member in cleaners of the present invention, the surface of each blade is provided with a number of projections so that the rotary cleaning member is not caught by cotton-like waste such as pieces of thread, pieces of cotton or the like in case where cleaning operation is performed on, as a matter of course, a flat surface of floor and even an irregular surface of floor, besides dust collecting property for fine dirt such as sand and the like is improved thereby to effect smooth cleaning operation.

What is claimed is:

1. In a cleaner having a rotary cleaning member comprising a shaft rotatably mounted in a main body casing, means for rotating said shaft, a plurality of flexible blades mounted radially on the surface of said shaft and adaptable to project through an opening in the underside of said casing to contact a surface to be cleaned, the improvement which comprises a plurality of projections on said blades extending substantially perpendicular thereto, whereby said blades flex when in contact with said surface to be cleaned to apply said projections to said surface to be cleaned.

2. The cleaner of claim 1 wherein each of said blades is spirally mounted on said surface of said shaft and said blades are substantially parallel to each other.

3. The cleaner of claims 1 or 2 wherein there is a plurality of windows extending through each of said blades and located adjacent said surface of said shaft.

4. The cleaner of claim 3 wherein the portion of each of said blades remote from said surface of said shaft defines a saw tooth shape.

5. The cleaner of claims 1 or 2 wherein the portion of each of said blades remote from said surface of said shaft defines a saw tooth shape.

* * * * *